US008910450B2

(12) United States Patent
Simon-Dominguez

(10) Patent No.: US 8,910,450 B2
(45) Date of Patent: Dec. 16, 2014

(54) METHOD AND DEVICE FOR STRENGTHENING AND LIGHTENING FLOOR AND ROOF FRAMING

(76) Inventor: Javier Antonio Simon-Dominguez, Mérida (MX)

( * ) Notice: Subject to any disclaimer, the term of this patent is extended or adjusted under 35 U.S.C. 154(b) by 24 days.

(21) Appl. No.: 13/511,020

(22) PCT Filed: Nov. 16, 2010

(86) PCT No.: PCT/MX2010/000130

§ 371 (c)(1),
(2), (4) Date: Sep. 25, 2012

(87) PCT Pub. No.: WO2011/062466

PCT Pub. Date: May 26, 2011

(65) Prior Publication Data

US 2013/0008114 A1 Jan. 10, 2013

(30) Foreign Application Priority Data

Nov. 20, 2009 (MX) ..... MX/A/2009/012586

(51) Int. Cl.
*E04B 1/00* (2006.01)
*E04G 11/44* (2006.01)
*E04B 5/26* (2006.01)

(52) U.S. Cl.
CPC ..... *E04G 11/44* (2013.01); *E04B 5/261* (2013.01)
USPC ..... 52/742.14; 52/327

(58) Field of Classification Search
CPC ..... E04B 1/161; E04G 23/02; E04G 11/50
USPC ..... 52/252, 602, 742.1, 742.13, 742.14, 52/319, 327, 335, 336
See application file for complete search history.

(56) References Cited

U.S. PATENT DOCUMENTS

| | | | |
|---|---|---|---|
| 808,951 | A | 1/1906 | Schuller |
| 1,461,409 | A | 7/1923 | White |
| 1,928,748 | A | 10/1933 | Young |

(Continued)

FOREIGN PATENT DOCUMENTS

| | | | |
|---|---|---|---|
| ES | 2013803 | A6 | 6/1990 |
| FR | 1488413 | A | 7/1967 |
| KR | 100788740 | B1 | 12/2007 |

OTHER PUBLICATIONS

Search report issued by the Spanish Patent Office in application PCT/MX2010/000130 on May 7, 2011.

*Primary Examiner* — William Gilbert
*Assistant Examiner* — Gisele Ford
(74) *Attorney, Agent, or Firm* — Browdy and Neimark, PLLC

(57) ABSTRACT

Method and device for strengthening and lightening floor and roof framing, using several devices, prefabricated beams, molds, mesh, concrete laid on site and where necessary reinforcing rods. The method involves affixing the device, including a section, two bolts and a pin, wrapped transversally around the beam. Several devices can be affixed along each beam. The beams are placed on their walls or girders, parallel and separated depending on the molds, then the molds are seated in the protruding segments of the bolts of the device until the spans are covered, affixing reinforcing rods in the sides of the device where necessary. The mesh is laid by attaching it to the ends of the devices. The concrete is poured until the compression slab and the channels above the beams are filled. Once set, the bolts are removed to recover the molds from below.

9 Claims, 5 Drawing Sheets

(56) References Cited

U.S. PATENT DOCUMENTS

| | | | | | |
|---|---|---|---|---|---|
| 2,731,824 | A * | 1/1956 | Hadley | 52/252 |
| 4,333,285 | A * | 6/1982 | Koizumi et al. | 52/252 |
| 4,387,544 | A * | 6/1983 | Schilger et al. | 52/405.1 |
| 4,685,264 | A * | 8/1987 | Landis | 52/252 |
| 5,459,967 | A * | 10/1995 | Bodtker | 52/93.1 |
| 5,657,595 | A * | 8/1997 | Fyfe et al. | 52/252 |
| 6,807,790 | B2 * | 10/2004 | Strickland et al. | 52/204.2 |
| 7,143,554 | B2 * | 12/2006 | Sachs et al. | 52/251 |
| 7,147,197 | B2 * | 12/2006 | Dalton | 249/25 |
| 8,365,473 | B2 * | 2/2013 | Bjerre | 52/79.9 |
| 8,484,907 | B2 * | 7/2013 | Black et al. | 52/91.3 |
| 2008/0028719 | A1 * | 2/2008 | Rutledge | 52/690 |

* cited by examiner

METHOD AND DEVICE FOR STRENGTHENING AND LIGHTENING FLOOR AND ROOF FRAMING

FIELD OF THE INVENTION

The present invention is applied in the technical field of construction, mainly for the framing of floor and roof of reinforced concrete in buildings, houses, bridges, or in constructions general.

BACKGROUND OF THE INVENTION

Nowadays many procedures for the manufacture of floor and roof framing of reinforced concrete are based on placement on the walls and girders, prefabricated beams placed parallel to and separated from each other, such that when the blocks or moulds sit on their sides, the spans between the beams are covered, then a mesh is placed in a parallel plan exceeding the blocks, the concrete is then poured on the whole in order to form the compression slab. In said framings, the ruptures and cracks are very frequent due to the weak adherence between the smooth beam surfaces and the concrete forming the compression slab, thus impeding a suitable incorporation to work together, decreasing the absorption of the shear-stress and the loading capacity of the system. Also in these procedures it is difficult to place the mesh in the proper place, and if necessary, reinforcing rods. In many of these cases, the use of blocks of concrete which are encased in the system add an excessive weight with a practically null structural benefit. And if after setting of the framing, firmly affixing supports for ceiling roses, ducts, and lamps, is required, then it is necessary to drill into the framing, taking the risk of damaging it.

OBJECT OF THE INVENTION

The present invention applies in the technical field of construction, mainly in floor and roof framing of reinforced concrete, it is related to a procedure and to a simple and low cost device, capable of being adapted to all kind of prefabricated beams, using also moulds, mesh, concrete laid on site, and if necessary, reinforcing rods. With this invention, a framing is achieved wherein the compression slab and beams are firmly integrated, increasing the loading capacity of the framing, enhancing the shear-stress absorption, allowing bigger spaces in the longitudinal direction to the beams to be covered, and making it easier to properly place the mesh and reinforcing rods, if required. The invention also makes it possible to easily recover the moulds for re-use, lightening the framing, and therefore reducing the necessary requirements for the walls or girders wherein the framing is seated, notably reducing the related costs. The device lower section that is not covered with concrete remains available for the affixation of supports for ducts, ceiling roses, or any other suitable item without requiring drilling into the framing.

BRIEF DESCRIPTION OF THE DRAWINGS

As a complement of the description and to help for a better understanding of the invention, the following drawings are shown only in an illustrative a non-limitative manner, wherein.

DETAILED DESCRIPTION OF THE INVENTION

Figure 1:
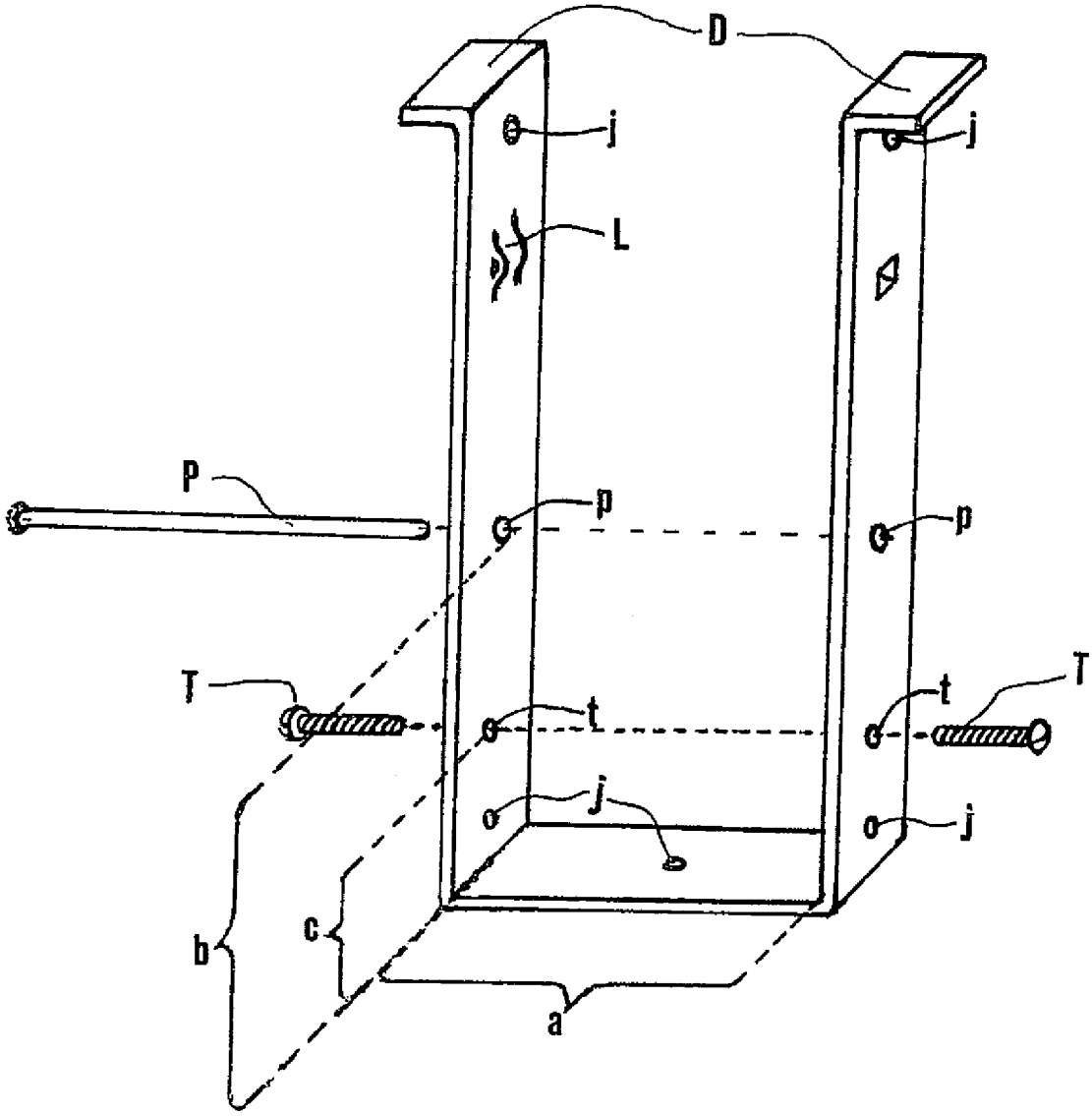
FIG. 1 shows a device according to the invention, wherein its different parts before the installation are shown.
Figure 2:
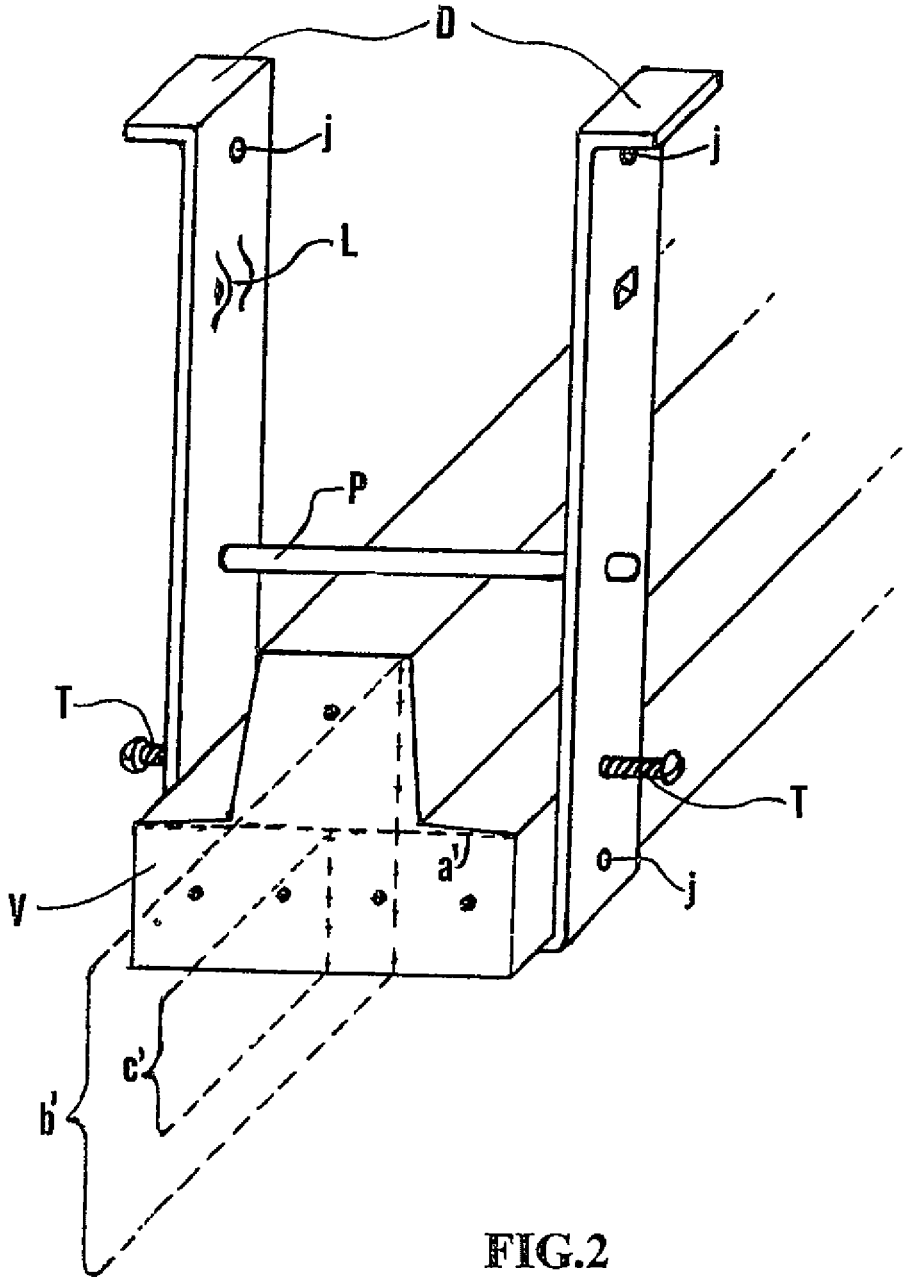
FIG. 2 shows the installed device in a type of beam.
Figure 3:
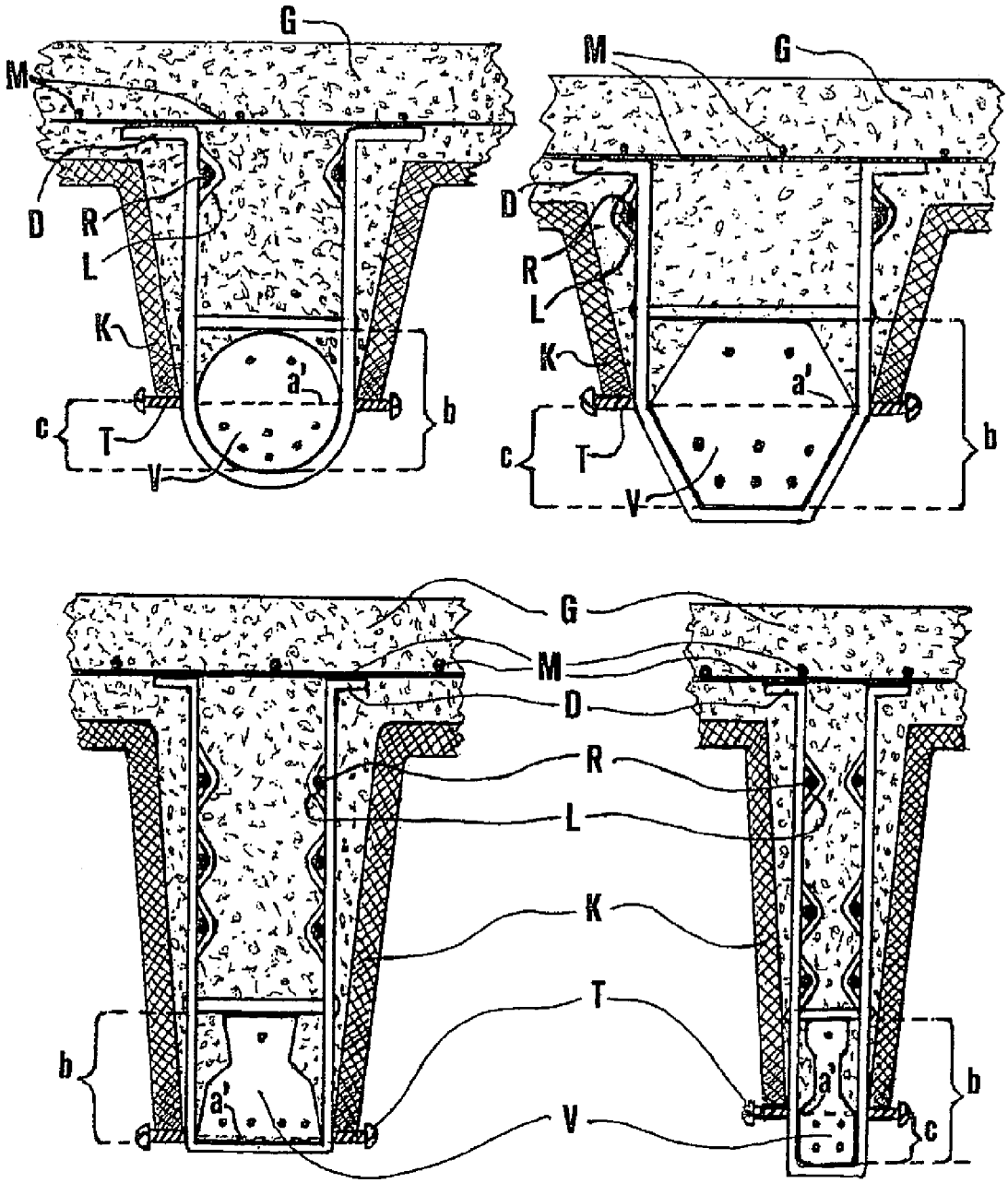
FIG. 3 shows cross-sections of different types of beams with their respective devices already installed therein, with placed moulds, mesh, some reinforcing rods, and the poured concrete.
Figure 4:
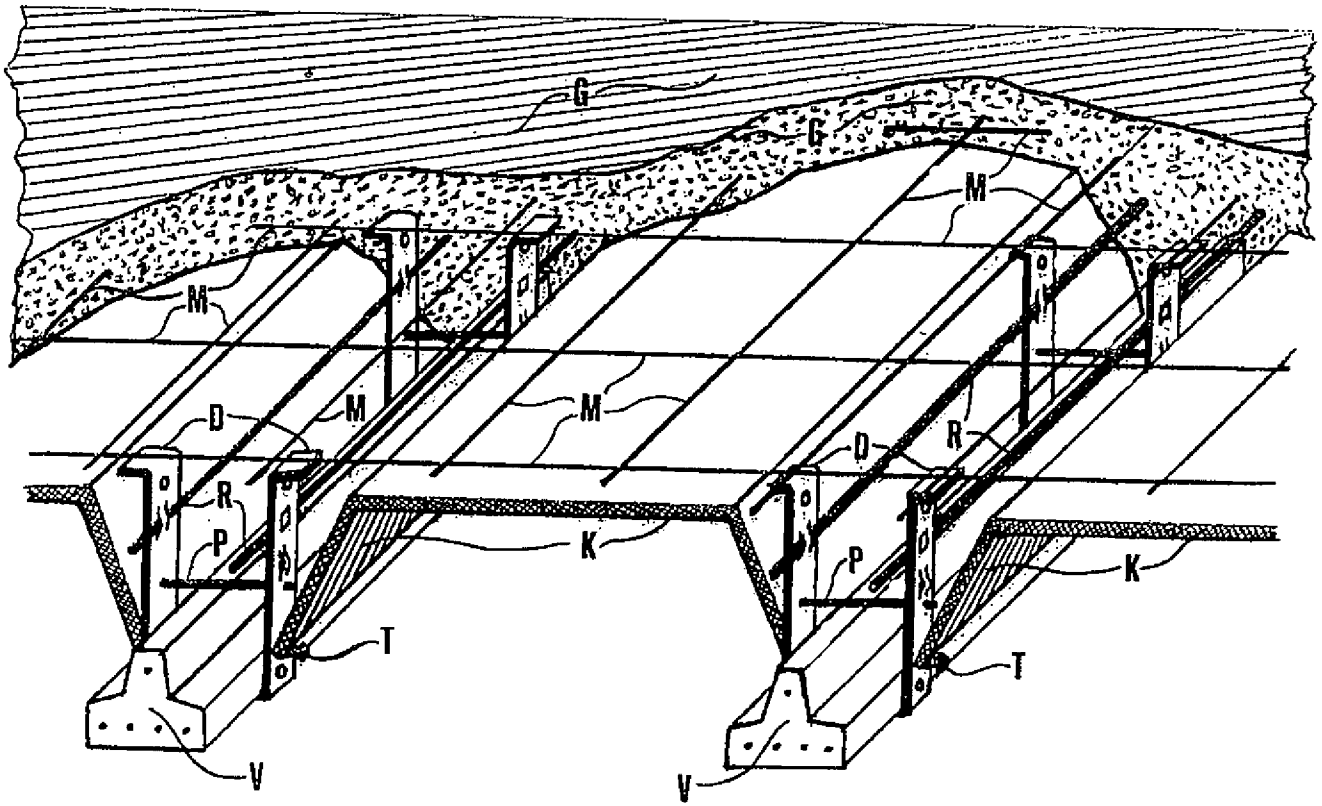
FIG. 4 shows various devices installed in the beams, with their moulds, mesh, reinforcing rods, and a portion of the poured concrete.
Figure 5:
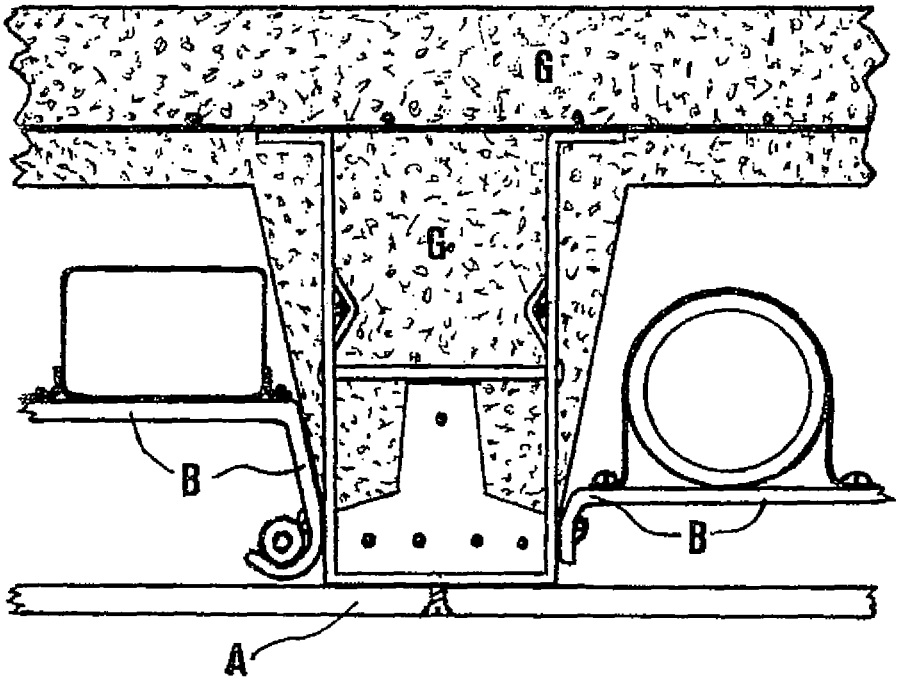
FIG. 5 shows a framing cross-cut, wherein the beam, the device, the mesh, the reinforcing rods, and the set concrete can be seen, wherein the moulds have been removed, wherein the installation of some supports for ducts and ceiling roses can be seen in the section of the device external to the concrete.

Method and device for strengthening and lightening floor and roof framing will be described with reference to FIGS. 1-5.

The method uses mainly some devices, prefabricated beams (V), moulds (K), mesh (M), concrete laid on site (C), and if necessary, reinforcing rods (R). The method is characterized by preferably starting transversally installing a device in the beam, the device consisting of a profile (A), a pin (P) and two screws (T). The profile (A) is made from a tensile-strength resistant material, preferably folded into a "U" shape, which shape conforms to the shape of the beam (V) that is used. The lower section of the profile has an inner wall, which conforms to the shape and dimensions of the base and adjacent sides of the cross-section (V) of the beam. When the profile sides reach the level where the cross-section of the beam has its higher width (a'), the profile sides are perpendicularly extended with respect to its base plane (B). The spacing between the profile sides (a) is equal to the maximum width (a') of the beam cross-section, said sides continue until reaching a height over said plane, equal to the distance from the beam base to the determined plane to affix the mesh (M) which will form part of the compression slab. The profile sides will have in their ends some folds (D) in order to form anchorages. The profile will have several holes (J) and projections (L). The profile is transversally placed on the beam, by placing the profile base in contact with the beam base, and the profile sides adjacent to the profile base in contact with the beam sides or the beam edges, adjacent to the beam base.

Then, the pin (P), which consists of an essentially straight rod, is affixed from one to other of the profile sides, being able to use said holes (p) in both sides. The pin is inserted parallel to the profile base plane and at a distance (b) from this plane, at a height equal to the height (b') of the beam cross-section, such that the pin touches the beam upper section, avoiding the displacement of the profile downwards of the beam. The two screws (T) will be housed, symmetrically facing each other, in holes (t) in both profile sides, located at a height (c) from the profile base plane equal to the distance (c') from the base of the beam cross-section up to the level wherein the section has its higher width (a). The screws (T) will have enough length to cover the profile thickness and to have a remaining segment in order to settle the side edges of the moulds (K).

Then, several of these devices will be similarly installed along the beams, spaced from each other according to the requirements of the situation. After, the beams will be settled in their walls or girders, remaining parallel and spaced to each other at a distance according to the dimensions of the moulds. Subsequently, the moulds will be settled on the protruding segments of the bolts, until the spans are covered. If necessary, reinforcing rods (R) will be lengthwise or transversally installed with respect to the beams, the holes and projections of the device can be used as a support. Then, the mesh (M) will be placed by using the device ends (D) as a support. Further, the concrete is poured (C) over the system until filling the channels and the compression slab. After the concrete has properly set, the screws (T) are removed in order to recover the moulds (K) from below in order to enable reuse of the moulds (K). The device lower section that is not covered by the concrete remains exposed for the affixation of supports (B) for: ducts, ceiling roses (A), or any other suitable item, without requiring drilling into the framing.

The device of the invention essentially consists of: a profile, two screws (T) and a pin (P). The profile will be made preferably from a tensile-strength resistant material, folded into a "U" shape, according to the beam (U) that is used. The inner wall of the shaped "U" profile base has the shape and length of the base of the cross-section of the beam that is used. The inner walls of the side sections adjacent to the profile base have the shape and length of the adjacent sides to the base of the beam cross-section up to the height where said section has its higher width (a'). From that height, the profile sides continue perpendicular to the profile base and with a spacing (a) between each other, equal to the higher width (a') of the beam part, until reaching a height over the profile base which will be equal to the distance from the beam base to the determined plane. To allow the mesh which will be integrated to the compression slab to be affixed to the profile, the profile ends (D) are folded to form anchorages at the free ends of the profile. The profile might have several holes (J) and projections (L).

The two screws (T) will be symmetrically housed facing to each other in holes (t) in both profile sides. The holes are located at a height (c) from the profile base plane, equal to the distance (e') from the base of the beam cross-section up to the level of the higher width (a') of said section. The screws (T) will have enough length to cover the profile thickness and to have a remaining segment in order to settle the side edges of the moulds. The pin (P) essentially consists of a substantially straight rod with a minimum length sufficient so that its ends can be affixed in the profile sides, being able to use said holes (P) in both sides. The pin remains parallel to the profile base plane and at a distance (b) from this plane, equal to the height (h') of the beam cross-section, such that when the profile is installed on the beam, the pin is affixed touching the beam upper section, and avoiding the displacement of the profile downwards of the beam.

The invention claimed is:

1. A method for strengthening and lightening floor and roof framing using a plurality of molds, the method comprising:

transversally installing on each of a plurality of prefabricated beams a device comprising a one-piece tensile-strength resistant profile having two walls connected by a base, two screws and a pin, and at least one of holes or projections to receive reinforcing rods to be used in combination with the prefabricated beam, the profile having a lower part, in such a manner that an inner face of the base of the profile is in direct contact with a base of the prefabricated beam and the walls of the profile are in direct contact with edges and adjacent sides of the prefabricated beam;

placing the screws into threaded holes for housing the screws in both profile walls until reaching the prefabricated beam without perforating the prefabricated beam, leaving a screw segment remaining protruding outwardly from an exterior surface of one of the two profile walls, wherein the threaded holes are formed in the walls of the profile symmetrically at a height from the base of the profile that is lower than a height of the prefabricated beam;

fixing the pin from a first one of the profile walls to a second one of the profile walls using the holes for housing the pin in both profile walls, the pin remaining parallel to the profile base and at a distance from said base equal to the beam height;

positioning the plurality of prefabricated beams with the installed devices, such that the beams are spaced apart from each other at a distance equal to a cross-sectional size of the molds on parallel walls or girders;

positioning the molds on the screw protruding segments between adjacent ones of the profiles to form channels partially surrounding the prefabricated beams and the profiles;

pouring the concrete to cover a top of the mold and fill the channels such that the screws are not encased in the concrete; and after the concrete is set, removing the screws and the molds.

2. The method of claim 1, further comprising, after settling the prefabricated beams on parallel walls or girders, installing reinforcing rods lengthwise or transversally with respect to the beams, such that the reinforcing rods are supported by the holes and projections of the device.

3. A device for strengthening and lightening floor and roof framing comprising:

a one-piece tensile-strength resistant profile, the profile having a lower part, two screws and a pin, and at least one of holes or projections to receive reinforcing rods to be used in combination with a prefabricated beam, that has a base, a mesh, and removable molds;

wherein:

the profile is symmetrically folded to envelope the prefabricated beam in said lower part and comprises a base and two sides having free ends, said two sides extending substantially parallel to each other toward the free ends;

the profile has threaded holes for housing the screws and holes for housing the pin;

an inner wall of the base of the profile is coincident with a shape of the base of the prefabricated beam;

the holes for housing the pin are each one in each of the profile sides and symmetrically facing each other, said holes for housing the pin are located at a height from the base of the profile that is equivalent to a height of the prefabricated beam;

the threaded holes for housing the screws are defined in each of the profile sides and symmetrically facing each other, said threaded holes being located at a height from the base of the profile that is lower than the height of the prefabricated beam;

the screws are affixed through the threaded holes and have a length sufficient to extend completely through the profile sides and further include a protruding segment of the screws remaining outward of the profile sides, the protruding segment having a length greater than a length of heads on the screws, screw protruding segments removably affix removable molds to form channels that partially surround the prefabricated beams and the profiles when in use;

the profile free ends receive the mesh, when in use; and the pin essentially consists of a substantially straight rod, and has a minimum length sufficient so that the pin can be affixed into the holes for housing the pin defined in both profile sides.

4. The device of claim 3, wherein the profile has a substantially "U" shape.

5. The device of claim 3, further comprising reinforcing rods.

6. The device of claim 5, wherein the profile comprises holes for the reinforcing rods.

7. The device of claim 3, wherein the profile ends comprise anchorage folds extending perpendicularly of the free ends of the sides of the profile.

8. The device of claim 7, wherein the anchorage folds extend perpendicularly outwardly of the free ends of the sides of the profile.

9. The device of claim 7, further comprising, after settling the prefabricated beams on parallel walls or girders, placing a mesh such that the mesh is supported by the anchorage folds.

* * * * *